US009339156B2

(12) United States Patent
Wang et al.

(10) Patent No.: US 9,339,156 B2
(45) Date of Patent: May 17, 2016

(54) COVER INSTALLATION

(75) Inventors: Yihua Wang, Shanghai (CN); Eric M. Plate, Plymouth, WI (US); Nicholas W. Paterson, Whitefish Bay, WI (US)

(73) Assignee: SHANGHAI KOHLER ELECTRONICS, LTD. (CN)

( * ) Notice: Subject to any disclaimer, the term of this patent is extended or adjusted under 35 U.S.C. 154(b) by 961 days.

(21) Appl. No.: 13/473,513

(22) Filed: May 16, 2012

(65) Prior Publication Data

US 2013/0007951 A1 Jan. 10, 2013

Related U.S. Application Data

(63) Continuation-in-part of application No. PCT/CN2010/078801, filed on Nov. 16, 2010.

(30) Foreign Application Priority Data

Nov. 17, 2009 (CN) ..... 2009 1 1000211

(51) Int. Cl.

| | |
|---|---|
| ***A47K 13/10*** | (2006.01) |
| ***A47K 13/12*** | (2006.01) |
| ***A47K 13/14*** | (2006.01) |
| *A47K 13/02* | (2006.01) |
| *A47K 13/24* | (2006.01) |

(52) U.S. Cl.

CPC ..... *A47K 13/10* (2013.01); *A47K 13/12* (2013.01); *A47K 13/14* (2013.01); *A47K 13/247* (2013.01); *A47K 13/02* (2013.01); *A47K 13/105* (2013.01); *A47K 13/242* (2013.01); *A47K 13/245* (2013.01)

(58) Field of Classification Search

CPC ..... A47K 13/10

USPC ..... 4/242.1, 246.1, 246.3

See application file for complete search history.

(56) References Cited

U.S. PATENT DOCUMENTS

| | | | |
|---|---|---|---|
| 1,342,505 | A | 6/1920 | Kinch |
| 1,398,556 | A | 11/1921 | Kinch |
| 1,506,459 | A | 8/1924 | Street |

(Continued)

FOREIGN PATENT DOCUMENTS

| | | |
|---|---|---|
| CN | 2620524 | 6/2004 |
| CN | 1840790 | 10/2006 |

(Continued)

OTHER PUBLICATIONS

Notification of Transmittal of Translation of the International Preliminary Report of Patentability in PCT/CN2010/078801.

(Continued)

*Primary Examiner* — Huyen Le

(74) *Attorney, Agent, or Firm* — Foley & Lardner LLP

(57) ABSTRACT

A cover installation 120 includes a cover 40 which is connected to the base 60 by a connecting module 80. The connecting module 80 enables the cover 40 to be opened and closed. A driving device 30 drives the connecting module 80 so that the cover is automatically opened and closed. A locking module can allow the cover 40 to be operated manually by disabling the driving device 30. Two connecting components 82 and 84 are connected to the cover 40 and configured to allow the top surface of the cover 40 to face the user when the cover 40 is opened automatically, while allowing the bottom surface of the cover 40 to face the user when the cover 40 is opened manually.

20 Claims, 13 Drawing Sheets

(56) References Cited

U.S. PATENT DOCUMENTS

| | | | | |
|---|---|---|---|---|
| 2,219,044 | A | 10/1940 | Horr | |
| 3,392,411 | A | 7/1968 | Hansen | |
| 3,670,441 | A | 6/1972 | Blount | |
| 6,226,804 | B1 * | 5/2001 | Ballard | A47K 13/10 4/246.1 |
| 6,263,517 | B1 | 7/2001 | Brooks | |
| 2006/0005309 | A1 | 1/2006 | Aurora | |
| 2007/0017014 | A1 * | 1/2007 | Dismuke | A47K 13/105 4/246.1 |

FOREIGN PATENT DOCUMENTS

| | | |
|---|---|---|
| JP | 2005095502 | 4/2005 |
| WO | WO2008/029388 | 3/2008 |

OTHER PUBLICATIONS

European Extended Search Report dated Dec. 14, 2015 from related European patent application EP 10831125.

* cited by examiner

COVER INSTALLATION

CROSS-REFERENCE TO RELATED PATENT APPLICATIONS

This application is a continuation in part of International Application PCT/CN2010/078801, filed Nov. 16, 2010, incorporated herein by reference in its entirety, which claims priority from Chinese Application No. 200911000211.0, filed Nov. 17, 2009, incorporated herein by reference in its entirety.

FIELD OF THE INVENTION

The present invention is essentially related to a kind of cover installation or lid assembly for a toilet bowl or bidet.

BACKGROUND OF THE INVENTION

The prior art includes the U.S. Pat. No. 1,342,505. The '505 patent is related to a toilet cover, which is coupled to the bidet or toilet with a hinge, so that the cover is opened by pivoting movement. In the '505 patent, the top surface of the cover faces the user serving as a back rest. The cover can be opened manually by lifting the handle. The handle is arranged in such a way so as to ensure that the top surface of the cover faces the user at all times when opened. When the body weight of the user is removed from the seat, the cover will fall to the closed position. U.S. Pat. No. 1,398,556 describes a kind of toilet cover which is opened by pressing a press bar. The body weight of the user on the press bar will force the cover to open. When the body weight of the user is removed from the press bar, the cover will fall to the closed position. The '556 patent discloses a toilet cover where the bottom surface of the cover faces the user, and another embodiment, wherein the top surface of the cover faces the user.

U.S. Pat. No. 2,219,044 is related to the toilet cover which is automatically operated by pressing a bar or pushing a button. The electromotor drives the cover to the opened position and enables the top surface of the cover to face the user. The lifting rod and the controlling bar are both pivotally connected to the cover and the toilet body. The '044 patent describes that the cover is fully automatically opened or closed. The United States Patent Application Publication No. 2006/0005309 is related to a kind of toilet cover which is manually operated through a handle, manually operated through a pedal or automatically operated through a motor. When the cover is opened, the bottom surface of the cover faces the user. The application discloses that a dual system can be an option.

Other prior art includes: International Patent Application Publication No. WO/2008/029388 which is related to the toilet cover that is automatically operated by an electric drive. A clutch system can optionally cut off the driving mechanism, so as to allow the cover to be manually operated in case at the absence of the rotation of electric motor. When the cover is opened, the bottom surface of the cover faces the user. Japanese patent application No. 2005-95502 describes a kind of toilet cover which can be opened and closed automatically. The cover includes two independent parts which are hinged together. When the cover rises, the front part of the cover bends downwards so as to ensure the front top surface of the cover faces the user.

What is needed is a toilet cover installation that allows a user to more easily open or close the cover automatically or manually, to a variety of positions, while allowing manual operation of the cover without damaging the driving device.

SUMMARY OF THE INVENTION

One embodiment of the present invention is related to an improved cover installation. The improved cover installation includes a base, a cover, and a connecting module which is used to connect the cover to the base. The cover installation further includes a plurality of connecting components, each of which is provided with coupling points to the cover and the base so as to allow rotational operations of the cover. One of the connecting components thereof implements pivoting movement with a pivot component, and while another connecting component moves in a pathway in sliding manner. In an exemplary embodiment, when the cover is in the opened position, the top surface of the cover can face the user or turn its back to the user.

Pursuant to another aspect or embodiment, the driving device is connected to at least one connecting component. The driving mechanism drives the connecting component to rotate about an axis so as to open or close the cover. For example, the user can activate said driving mechanism so as to automatically open or close the toilet cover. The sliding of the connecting component in the pathway can be selectively restricted, which prevents or allows the cover to revolve around the pivotal point of another connecting component. For example, in the automatic operation of the cover, the connecting component can be restricted within the pathway, allowing the cover to revolve around the pivotal point of another connecting component and to enable the top surface of the cover to face the user when the cover is in the opened position. Alternatively, during manual operation of the cover, the sliding of the connecting component may not be restricted in the pathway, preventing the cover from revolving around the pivotal point of a connecting component and causing the bottom surface of the cover to face the user when the cover is in the opened position.

In another aspect or embodiment of the present invention, the locking module can retain part of one of the connecting components in the pathway so as to facilitate the automatic operation of the cover. The connecting component can break away from the locking module to provide for manual operation of the cover without destroying the driving device of the cover. For example, the connecting component can be released from the locking module with some manual force, thereby allowing the cover to be opened or closed without enabling the driving device, so as to prevent the driving device from wearing or damage.

At least one aim of the embodiment of the present invention is to provide a cover installation which includes a base, a cover with a first surface and a opposite second surface. The cover installation further includes a connecting module having a first connecting component and a second connecting component. The connecting module is used to connect the base to the cover. The first connecting component is connected to the base by a first pivot component, and the first connecting component is connected to the cover by a second pivot component. The second connecting component is connected to the base by a third pivot component, and the second connecting component is connected to the cover by a fourth pivot component. The cover installation further can further include the sliding pathway described herein.

In one embodiment of the present invention, the sliding pathway is an integral part of the cover, and one of the second and the fourth pivot components is slidably set within the pathway. In another embodiment of the present invention, the sliding pathway is an integral part of the base, and one of the first and the third pivot components is slidably set within the pathway. In another embodiment of the present invention, said sliding pathway is an integral part of at least one of the first and the second connecting components. At least one of said connecting components includes at least two slidable coupling parts. In another embodiment of the present invention, the pivot component is a hinge.

An aspect of the present invention further includes at least one grip component coupled with the cover. Another aspect of the present invention further includes a locking module. Part of the first connecting component in the pathway can be restricted in releasable manner such that the first connecting component can not normally slide in the pathway (e.g., under automated force). One more aspect of the present invention further includes a driving device which is connected to at least one of the first and the second connecting components.

In another aspect of the present invention, the first connecting component is a kind of rod. In one more aspect of the present invention, the second connecting component is a kind of rod. In another aspect of the present invention, the pathway is a kind of groove.

Another aspect of the present invention further includes a pathway provided with a first end and a second end. In a closed position, the cover may extend forward from the mounting surface of the base and substantially parallel with the mounting surface of the base. The first surface of the cover faces away from the base. The cover may be moved to first and second opened positions. In the first and second opened positions, the cover may be set to be substantially vertical to the mounting surface of the base. In the closed position of the cover, the part belonging to the first connecting component, located in the pathway, is close to the first end of the pathway. In the first opened position of the cover, the part belonging to the first connecting component, located in the pathway, is close to the first end of the pathway and the first surface of the cover faces toward the bowl. In the second opened position of the cover, the part belonging to the first connecting component, located in the pathway, is close to the second end of the pathway and the second surface of the cover faces forward and toward the bowl.

DETAILED DESCRIPTION OF THE PREFERRED EMBODIMENTS

Figure 1:
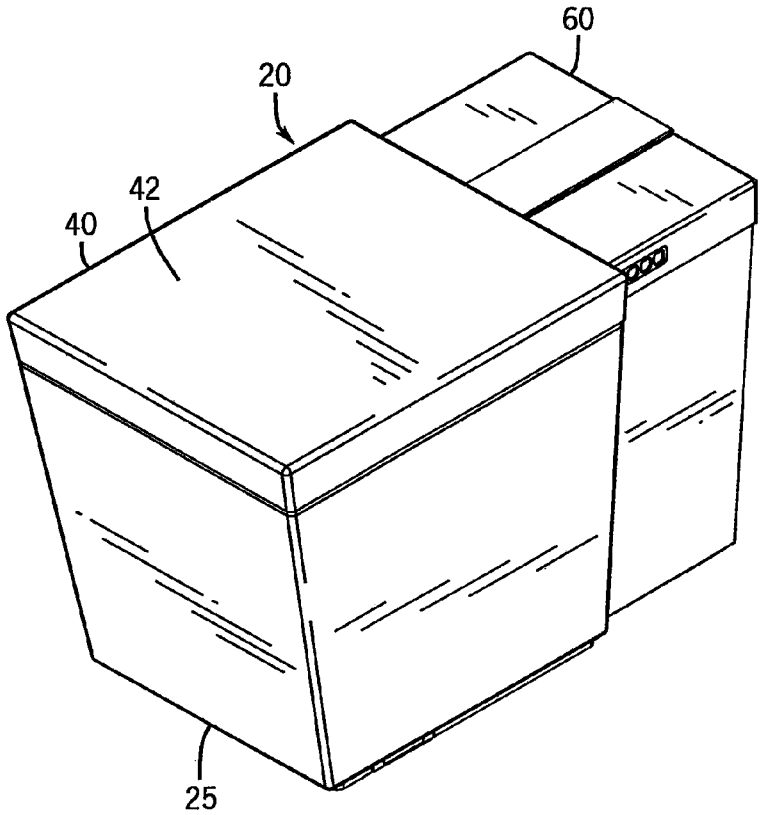
FIG. 1 is the perspective view of a toilet having a cover installation, according to an exemplary embodiment.
Figure 3:
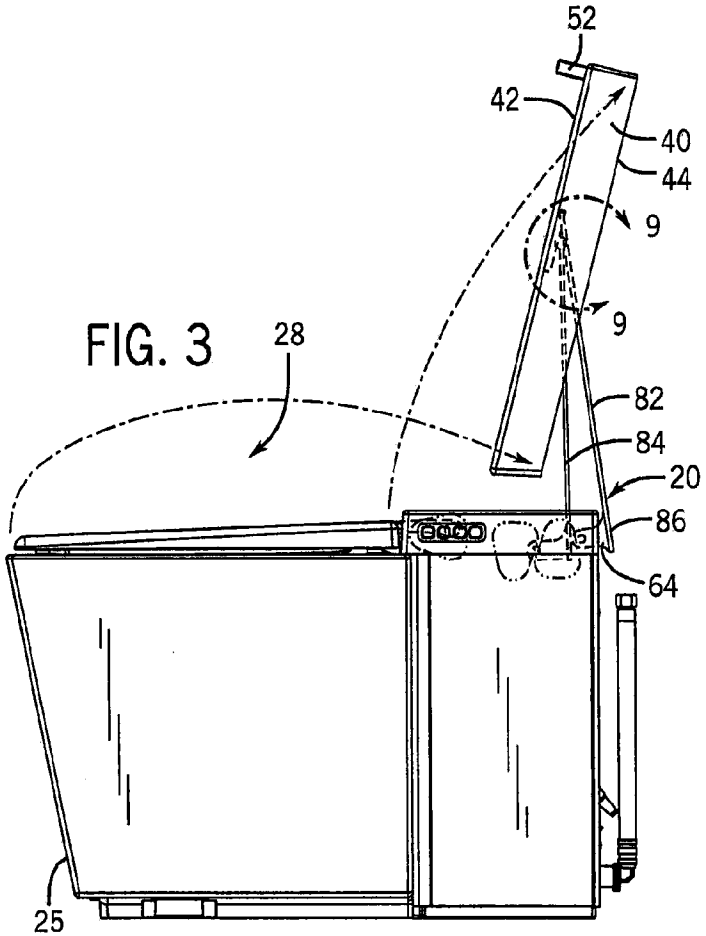
FIG. 3 is the side view of the toilet bowl as illustrated in FIG. 1 with its seat cover in the first opened position.
Figure 2:
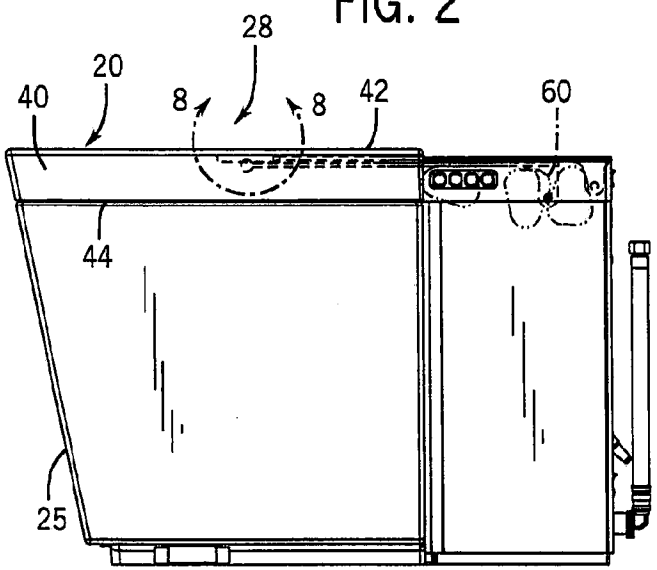
FIG. 2 is the side view of the toilet bowl as illustrated in FIG. 1 with its seat cover in closed position.
Figure 4:
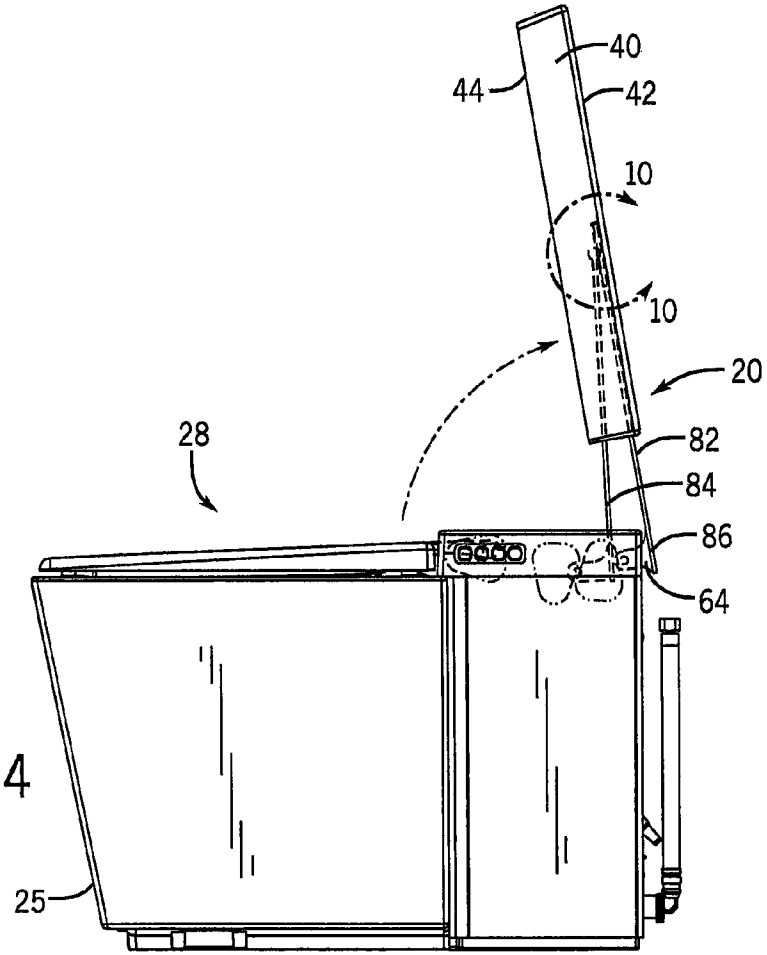
FIG. 4 is the side view of the toilet bowl as illustrated in FIG. 1 with its seat cover in the second opened position.

FIG. 1 shows an embodiment of the toilet bowl 25 with a cover installation 20. Examples of different positions of the cover 40 when using the toilet bowl 25 are illustrated from FIG. 2 to FIG. 4. When the cover 40 is in closed position, as shown in FIGS. 1 and 2, the cover 40 covers up the toilet bowl 25 in such a way that the first surface 42 of the cover 40 faces outward from the toilet bowl 25. As illustrated in FIG. 3, when the cover 40 is in the first opened position, the first surface 42 substantially faces the space 28. As illustrated in FIG. 4, when the cover 40 is in the second opened position, the first surface 42 substantially turns its back to the space 28.

Figure 5:
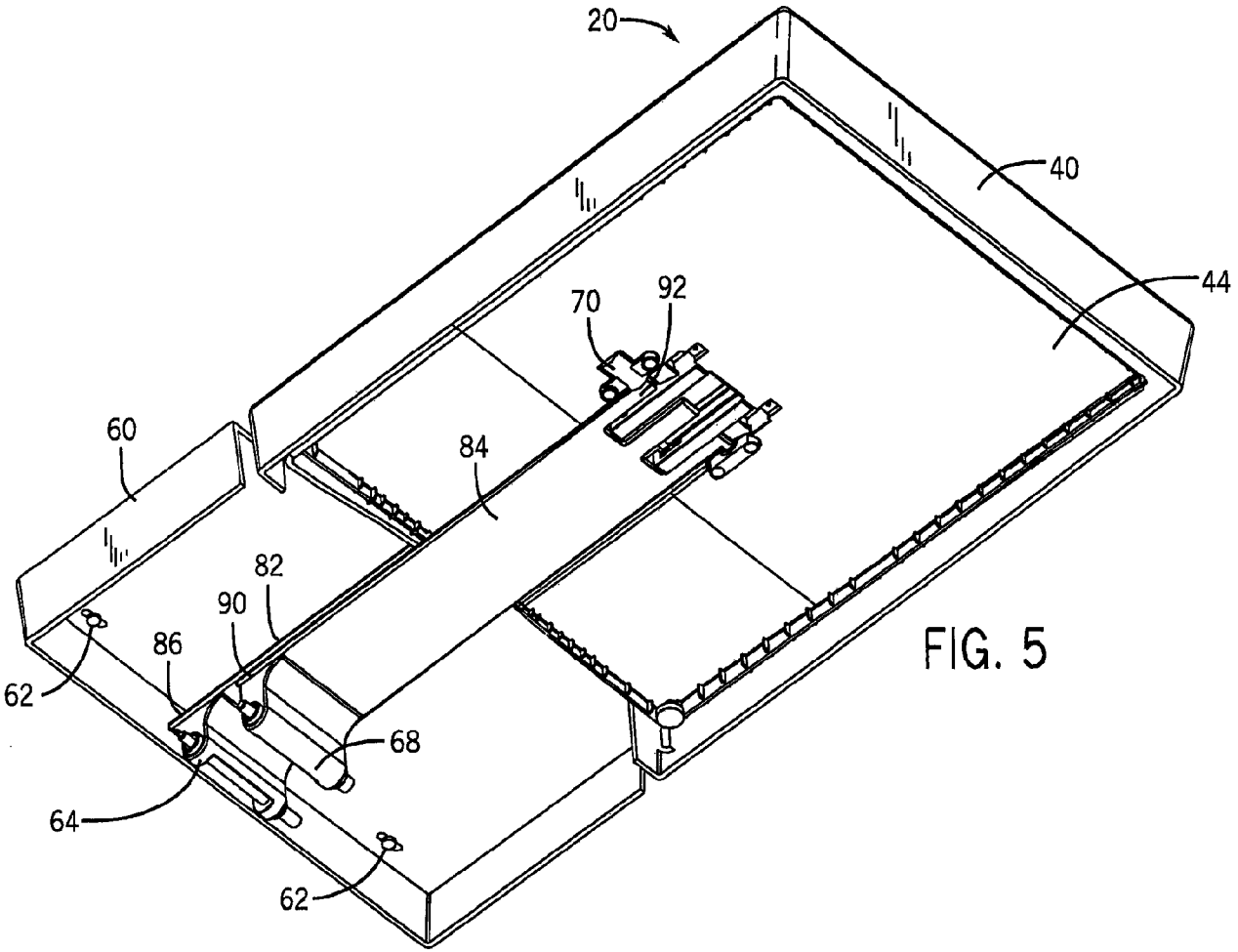
FIG. 5 is the perspective view of an embodiment of the cover installation.

FIG. 5 demonstrates an embodiment of the cover installation 20. The cover installation 20 includes a cover 40, a base 60 and a connecting module 80 (e.g., shown in greater detail in FIG. 7). The cover installation 20 can be applied, as an openable cover, into toilet bowls, bidets or other containers, according to varying exemplary embodiments.

Figure 6:
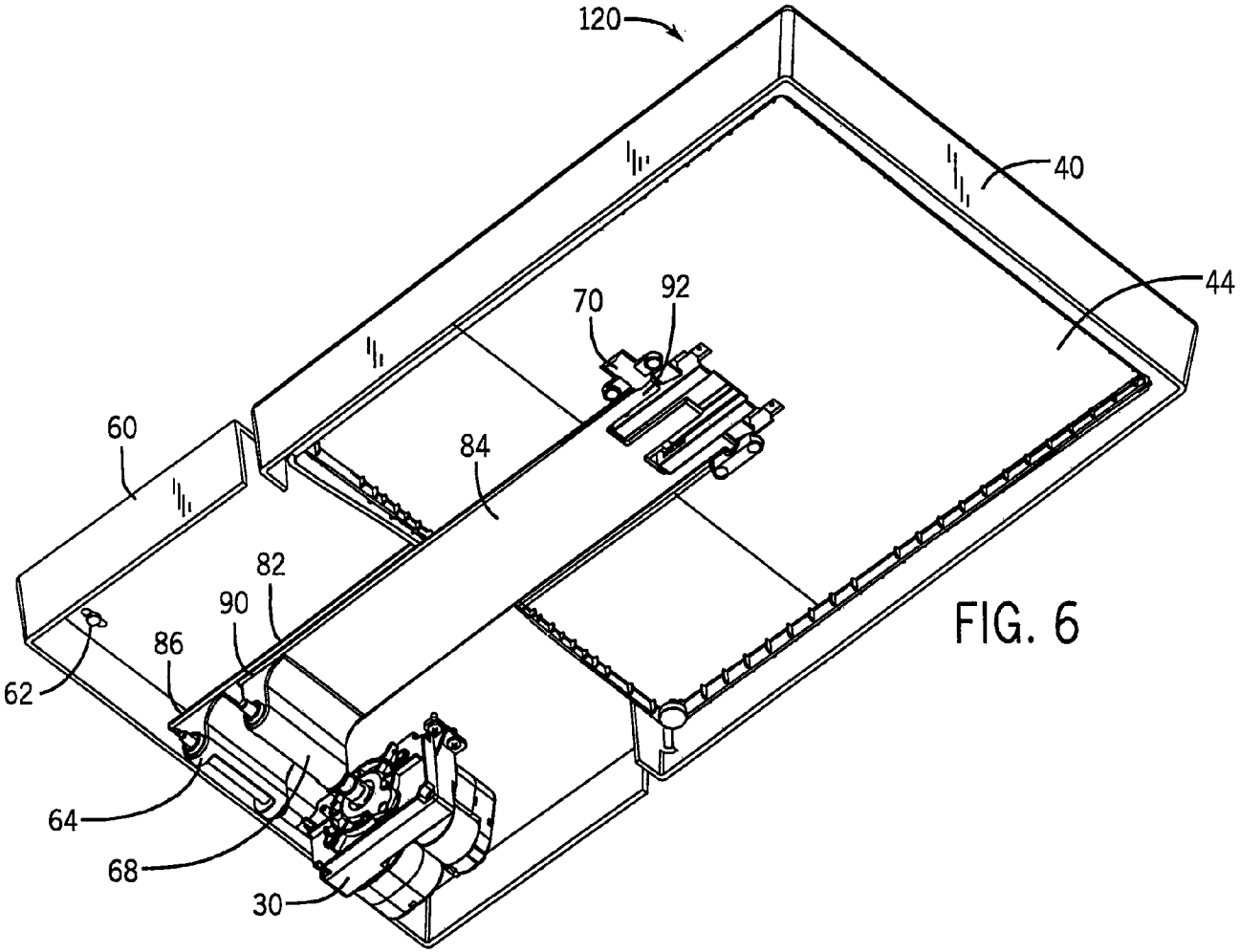
FIG. 6 is the perspective view of another embodiment of the cover installation.

FIG. 6 demonstrates another embodiment of the cover installation. The cover installation 120 includes a cover 40, a base 60, a connecting module 80, and further includes a driving device 30 (e.g., a motor). The cover 40 of the cover installation 120 can be opened and closed automatically (e.g., using driving force provided by the driving device 30), manually, or using a combination of automatic and manual. The embodiment of cover installation 120 illustrated hereby can be operated automatically and manually. For example, the cover installation 120 can automatically open and close the cover 40 using the driving device, the cover can be manually opened and closed, can be manually opened and automatically closed, or automatically opened and manually closed.

While not shown, in varying embodiments, the cover 40 can be a cover with an opening, such as the toilet seat of the toilet bowl. The cover 40 can be made from any standard industrial materials such as, but not limited to, plastics, ceramics or metals. As illustrated in FIGS. 5 and FIG. 6, the cover 40 includes the first surface 42 and the second surface 44. When the cover 40 is in closed position (e.g., FIG. 1, FIG.

2), the first surface 42 turns its back to the covered equipment and faces outward, and faces up to the space 28. For example, the first surface 42 can be the top surface of the cover 40. When the cover 40 is in closed position, said top surface turns its back to the toilet bowl 25 and faces upward. When the cover 40 is in closed position (e.g., FIG. 1, FIG. 2), the second surface 44 faces inwards and faces the covered equipment. For example, the second surface 44 can be the bottom surface of the cover 40. When the cover 40 is in closed position, the bottom surface faces downwards to the toilet bowl 25. The cover 40 can possess one or a plurality of grip components 52, as illustrated in FIG. 3. The grip component 52 can be, for example, a handle, an embossment, or a notch. The grip component 52 can be set at any position on the cover 40. The grip component 52 can be an integral part of an integrally molded cover 40 or an independent component relative to the cover.

The base 60 can be used to attach the cover installation 20 or the cover 120 to the equipment or the container, such as the toilet bowl or the bidet (FIG. 2). The base 60 can be made from any standard industrial materials such as, but not limited to, plastics, ceramics and metals. As can be seen in FIG. 5 and FIG. 6, at least one attaching component 62 connects the base 60 to the equipment. The attaching component 62 can be, for example, a cramp, a pillar, a screw, or a threaded rod. Alternatively, the attaching component 62 can be adhesives. The attaching component 62 can be an integral part of the integrally molded base 60 or an independent component. The size and shape of base 60 can be designed to be able to contain the driving device 30. The driving device 30 can be a motor or actuator. In an alternative embodiment, the driving device 30 can be installed outside the base 60. For example, the driving device 30 can be installed below or above the base 60.

Figure 7:
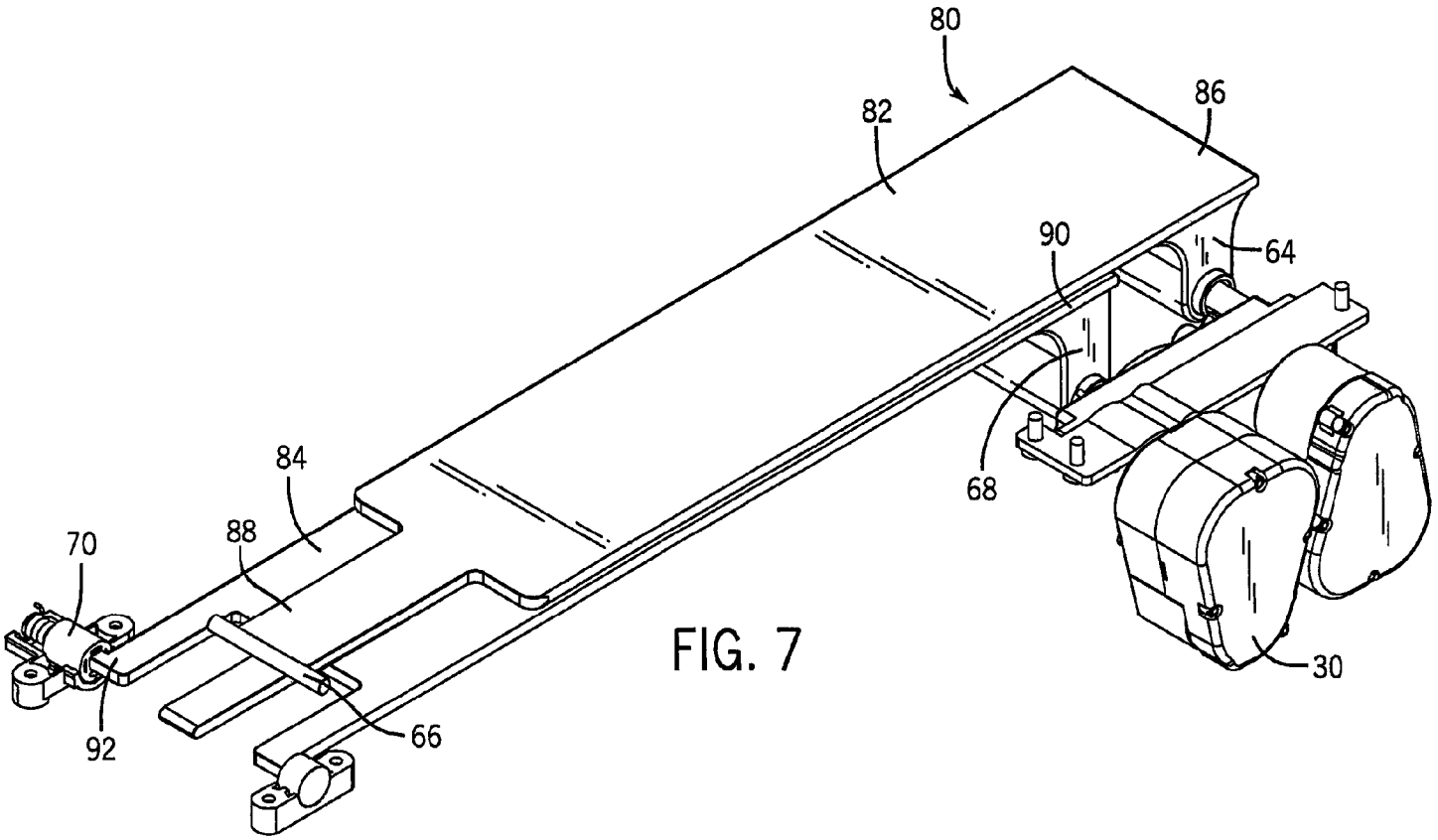
FIG. 7 is the perspective view of one embodiment of the connecting component.
Figure 8:
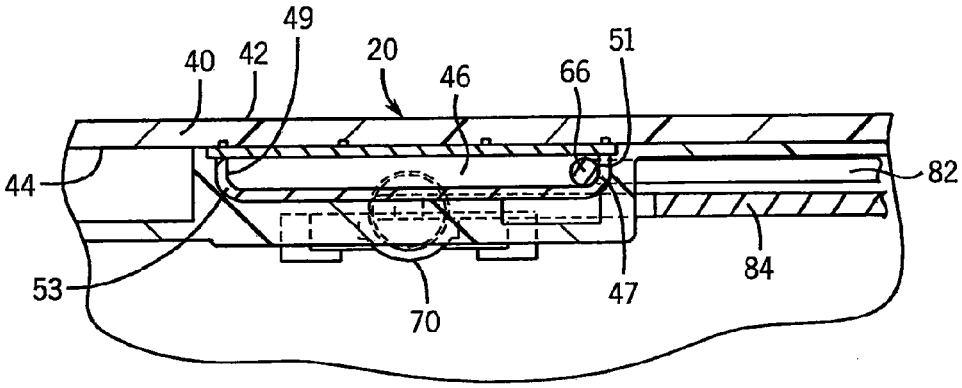
FIG. 8 is the partial side sectional view of the embodiment of the cover installation having a connecting component as illustrated in FIG. 7, the illustration of FIG. 8 showing the cover is in the closed position.
Figure 9:
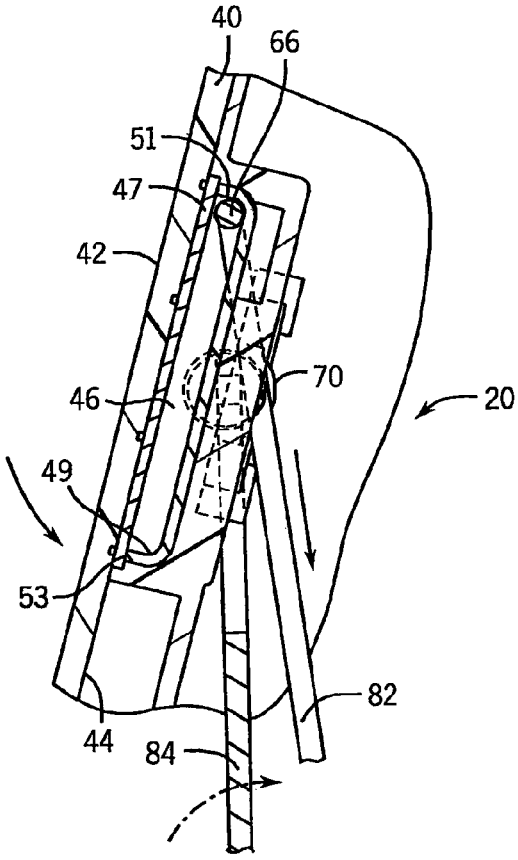
FIG. 9 is the partial side sectional view of the embodiment of the cover installation having a connecting component as illustrated in FIG. 7, the illustration of FIG. 8 showing the cover is in the first opened position.
Figure 10:
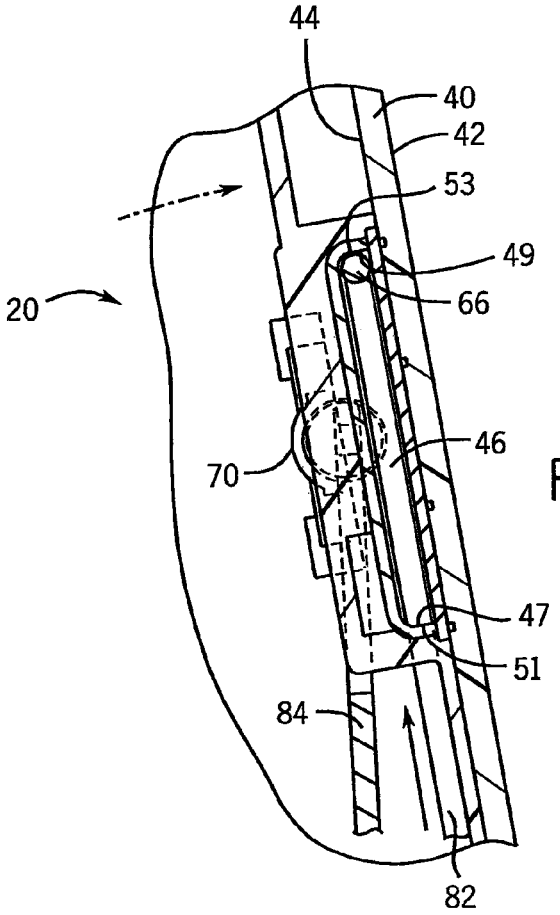
FIG. 10 is the partial side sectional view of the embodiment of the cover installation having a connecting component as illustrated in FIG. 7, the illustration of FIG. 10 showing the cover is in the second opened position.
Figure 11:
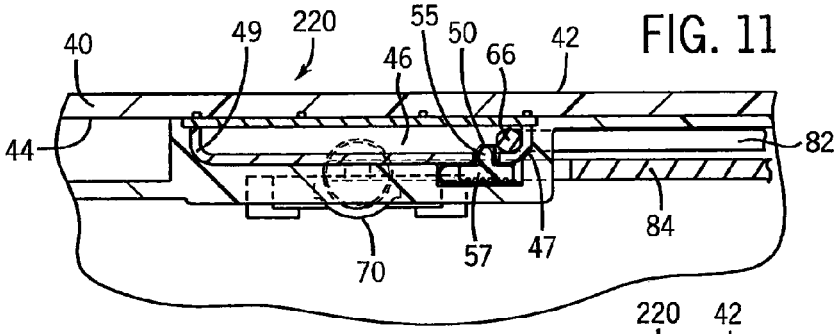
FIG. 11 is the partial side sectional view of the embodiment of the cover installation which includes a locking component and wherein the cover is shown in the closed position.
Figure 12:
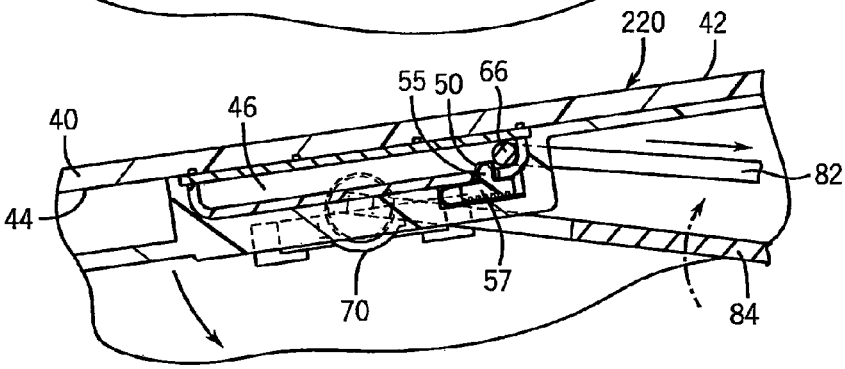
FIG. 12 is the side sectional view of the cover installation as illustrated in FIG. 11, wherein the cover is shown partially in the first opened position.
Figure 13:
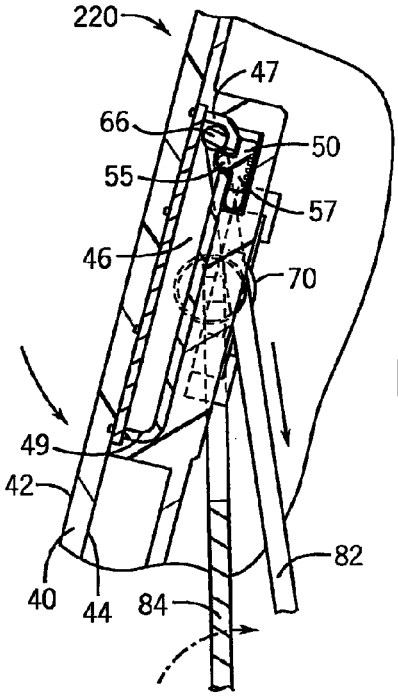
FIG. 13 is the side sectional view of the cover installation as illustrated in FIG. 11 wherein the cover is shown in the first opened position.
Figure 14:
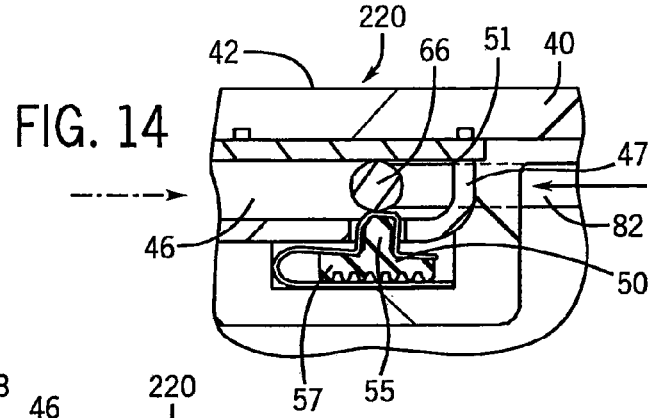
FIG. 14 is the side sectional view of the cover installation as illustrated in FIG. 11 wherein the cover is shown partially in the second opened position.
Figure 15:
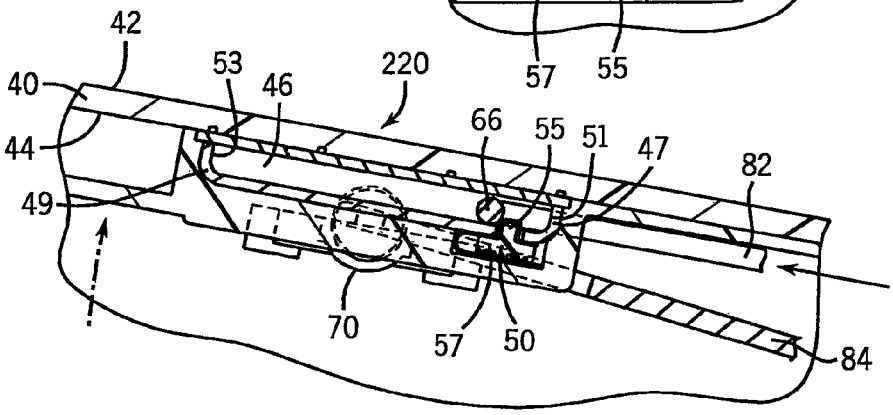
FIG. 15 is the side sectional view of the cover installation as illustrated in FIG. 11 wherein the cover is shown more partially in the second opened position.
Figure 16:
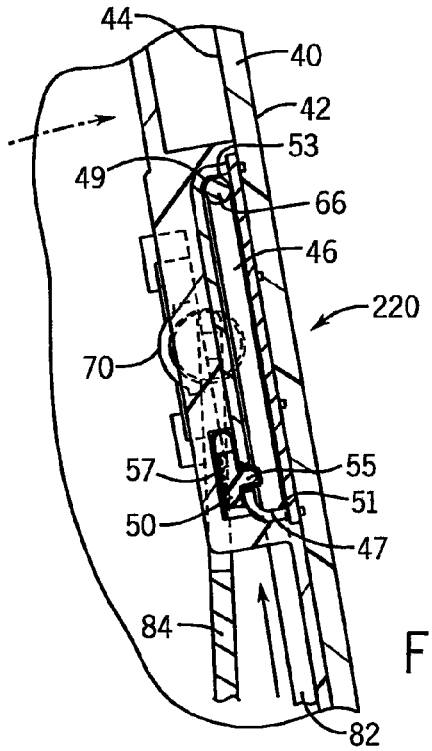
FIG. 16 is the side sectional view of the cover installation as illustrated in FIG. 11 wherein the cover is shown in the second opened position.

FIG. 5 and FIG. 6 demonstrate a connecting module 80 (as identified in FIG. 7), which connects the cover 40 to the base 60. The connecting module 80 includes a plurality of connecting components, for example, a first connecting component 82 and a second connecting component 84, as illustrated in FIG. 7. Alternatively, the connecting module 80 can include more than two connecting components. The first connecting component 82 and the second connecting component 84 can be made from any standard industrial materials such as, but not limited to, metals, plastics, and composite materials. A first pivot component 64 connects a first base 86 of the first connecting component 82 to the toilet base 60 using a pivotal connection. Referring also to FIG. 8 a pathway 46 in the cover 40 houses a first cover part 88 (identified in FIG. 7 as an extension of first connecting component 82) of the first connecting component 82 in pivotal and slidable manner. The pathway 46 can be a receptive pathway of any types, such as, but not limited to, a channel, a cavity, a groove or a slot. The pathway 46 of the embodiment as illustrated is a groove. The pathway 46 includes a first stop component 47 and a second stop component 49 (FIG. 8). The first stop component 47 prevents the first cover part 88 from sliding beyond the first position 51 in the pathway 46 (e.g., as illustrated in FIG. 9). The second stop component 49 prevents the first cover part 88 from sliding beyond the second position 53 in the pathway 46 (e.g., as illustrated in FIG. 10). The first stop component 47 and the second stop component 49 can be, for example, the end wall formed by a plurality of parts of the cover 40 or formed by the terminal part of components embedded in the pathway.

The second pivot component 68 connects the second base 90 of the second connecting component 84 to the base 60 by a pivotal connection. The third pivot component 70 of the cover 40 connects the second cover part 92 of the second connecting component 84 to the cover 40 by a pivotal connection.

In varying embodiments, each of the first pivot component 64, the second pivot component 68 and the third pivot component 70 is either a part of the cover 40 or a part of the base 60. The pathway 46 is either a part of the cover 40, or a part of the base 60 or a part of the connecting module 80. "A part" of the structure as mentioned above is defined as either integrally molded with the structure or as an annex of the structure. For example, as for the first pivot component 64, the second pivot component 68, the third pivot component 70, and the pathway 46, each of them can be either integrally molded with the cover 40 or the base 60, or can be an independent component annexed to the cover 40 or the base 60. For example, as for the first pivot component 64, the second pivot component 68 and the third pivot component 70, each of them can be an independent hinge which is annexed or installed to the cover 40 or the base 60. For example, pathway 46 can be a pathway which is formed in the independent component annexed to the cover 40 or the base 60. Or, for example, pathway 46 can be an integral part of the first connecting component 82 or the second connecting component 84. Alternatively, the pathway 46 can couple with another part of either the first connecting component 82 or the second connecting component 84. For example, both of the first connecting component 82 and the second connecting component 84 can be connecting components for retractable coupling.

The driving device 30 can be connected to at least one of the first pivot component 64, the second pivot component 68 and the third pivot component 70. For example, the driving device 30 can be connected only to the first pivot component 64, or can be connected only to the second pivot component 68, or can be connected to both the first pivot component 64 and the second pivot component 68 at the same time. Or, for example, the driving device 30 can be connected only to the third pivot component 70 or only to the pathway 46, or can be connected to the third pivot component 70 and the pathway 46 at the same time. The driving device 30 can thereby exert rotary force on only one of the first connecting component 82 and the connecting component 84, or can exert rotary force on both of the first connecting component 82 and the connecting component 84 at the same time. According to varying exemplary embodiments, a plurality of the driving devices 30 can be connected to a combination of the first pivot component 64, the second pivot component 68, the third pivot component 70 and the pathway 46.

Another embodiment of a cover installation 220 is illustrated from FIGS. 11 to 16. The cover installation 220 further includes a locking module 50 having at least one coupling component 55 that is suitable for coupling with the first connecting component 82's pivot 66. The locking module 50 can be made from any standard industrial materials such as, but not limited to, metals, plastics and rubbers. The coupling component 55 can be made of either rigid materials, such as, but not limited to, metal or rigid plastics, or can be made of magnetic or flexible materials, such as, but not limited to, soft rubber or soft plastic. The coupling component 55 can be an integral part of the integrally molded locking module 50, and the coupling component 55 can also be an independent component annexed to a locking base 57. The locking module 50 in the cover 40 can optionally constrain the first connecting component 82's pivot component 66. For example, at the locked position, the locking module 50 can constrain the first connecting component 82's pivot component 66, so as to prevent the first connecting component 82's pivot component 66 from sliding toward the stop component 49 in pathway 46. At the unlocked position, the locking module 50 does not constrain the first connecting component 82's pivot component 66, so as to allow the first connecting component 82's pivot component 66 to slide toward the stop component 49 in pathway 46.

Figure 17:
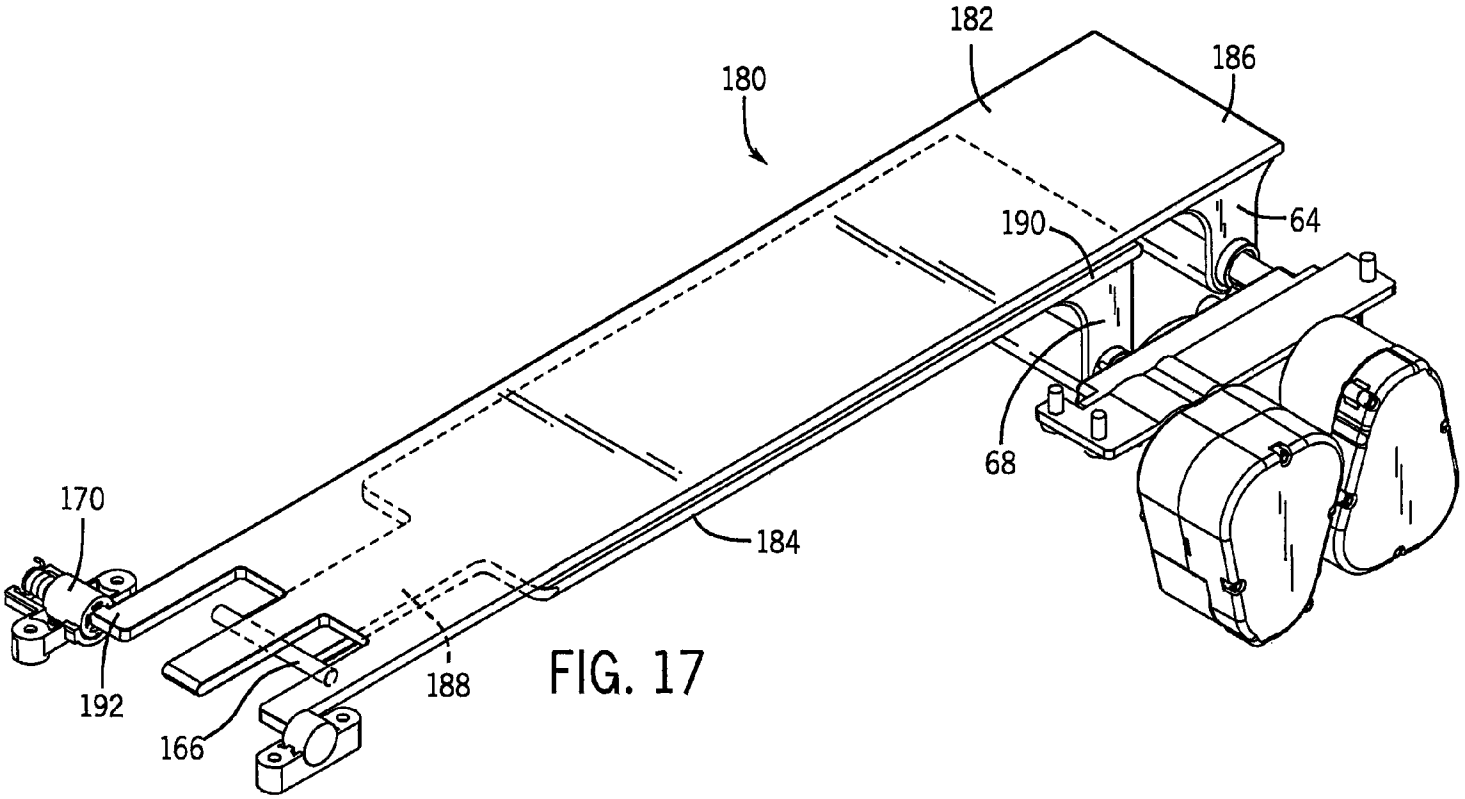
FIG. 17 is the perspective view of another embodiment of a connecting module.
Figure 18:
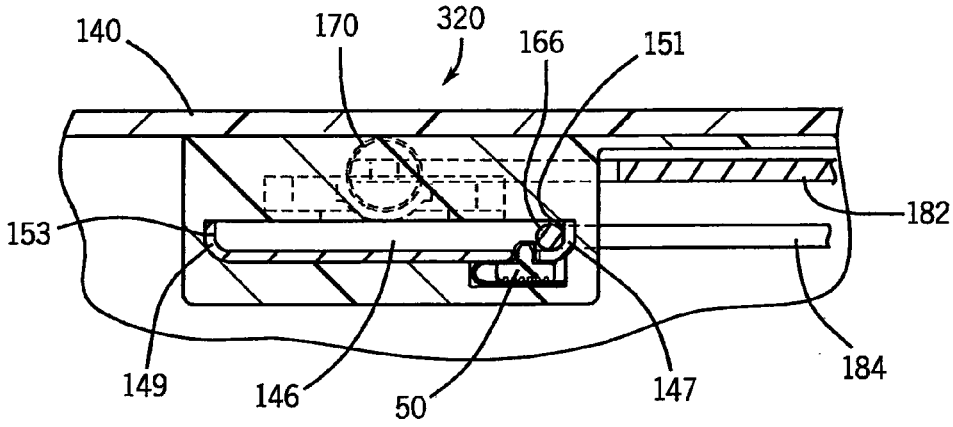
FIG. 18 is the partial side sectional view of an embodiment of a cover installation which includes a connecting component as illustrated in FIG. 17, wherein the cover is in the closed position.

Another embodiment of a cover installation 320 is illustrated in FIGS. 17 and 18. The cover installation 320 includes a connecting module 180, which includes a plurality of connecting components such as a first connecting component 182 and a second connecting component 184. The first connecting component 182 and the second connecting component 184 can be made of any standard industrial materials such as, but not limited to, metal, plastics and composites. The first pivot component 64 connects the first base part 186 of the first connecting component 182 to the base 60 by a pivotal connection. A third pivot component 170 of the cover 140 connects a first cover part 192 of the first connecting component 182 to the cover 140 by a pivotal connection. A second pivot component 166 connects the second base part 190 of the second connecting component 184 to the cover 140 by a pivotal connection. The pathway 146 in the cover 140 contains a second cover part 188 of the second connecting component 184 in slidable manner. Another pivot component 68 (e.g., a fourth pivot component) connects the second base part 190 of the second connecting component 184 to the base 60. The first stop component 147 constraints the second cover part 188 and first connecting component 182 from sliding beyond the first position 151 in pathway 146. The locking module 50 optionally resiliently constraints the second cover part 188 from sliding toward the second stop component 149, which is located at the second position 153 in the pathway 146.

Figure 19:
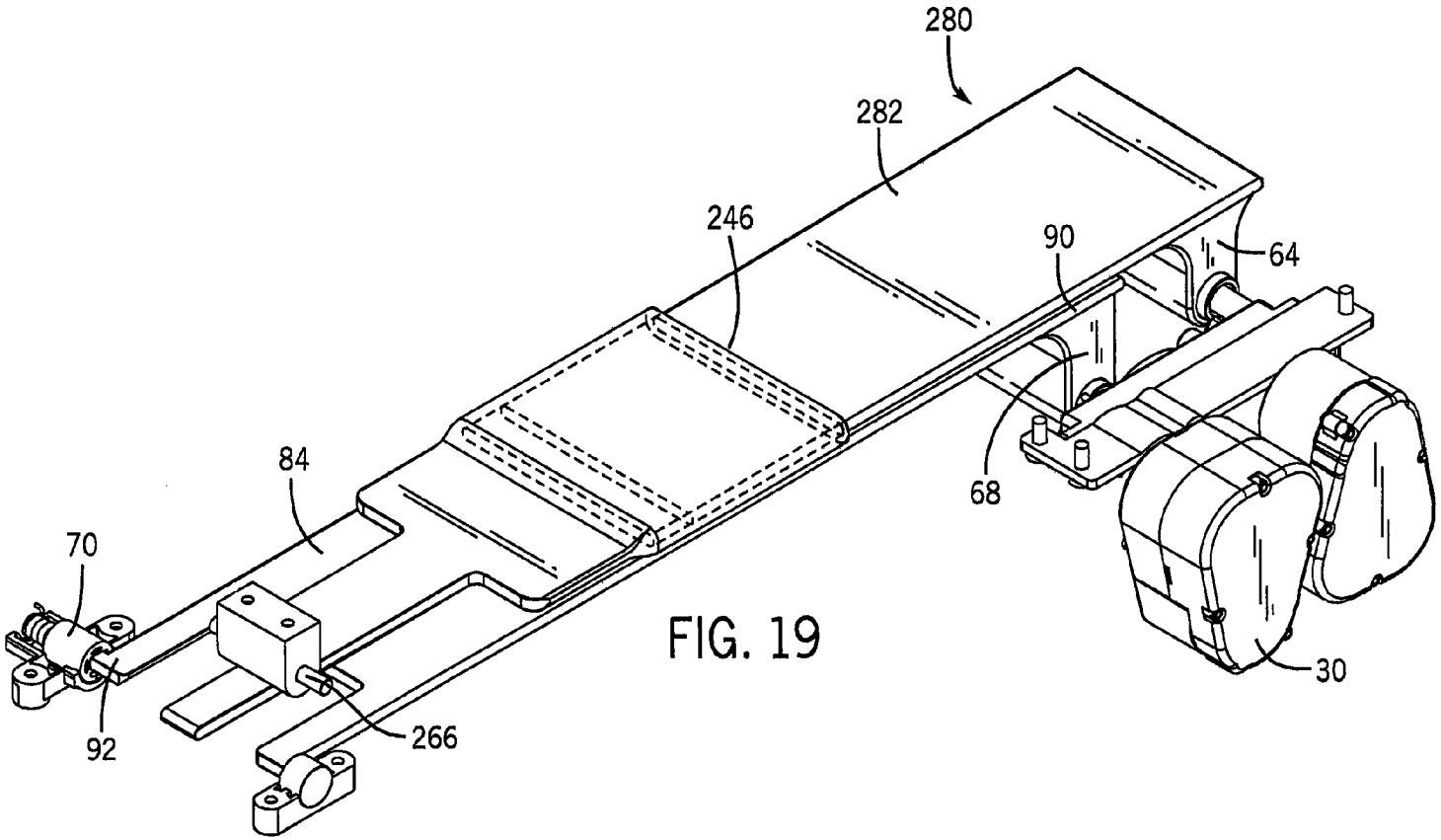
FIG. 19 is the perspective view of another embodiment of the connecting module.

FIG. 19 demonstrates another embodiment of a connecting module 280. The connecting module 280 includes a first connecting component 282 is connected to the first pivot component 64. Connecting module 280 also includes the second connecting component 84, which is connected to the second pivot component 68 and the third pivot component 70. The first connecting component 282 has a base portion telescopically engaged with the pathway 246, which is connected, in retractable manner, to the first cover part having pivot component 266. Alternatively, the second connecting component 84 can be a retractable component that includes a pathway 246 or the first connecting component 282 and the second connecting component 84 can both be retractable components that include a telescoping pathway 246. The pathway 246 can optionally include a locking module.

Referring again to FIGS. 1-10, the cover installation 20 allows the user to manually open and close the cover 40 manually. By pulling the grip component 52 outwards, the user can manually open the cover 40 to the first opened position (e.g., illustrated in FIG. 3), which enables the first surface 42 to face the space 28. The pulling force exerted on the grip component 52 makes the cover 40 lift and revolve around the axis of the third pivot component 70. The first cover part 88's pivot component 66 is pressed to the first stop component 47 and thus is prevented from sliding farther away from the second stop component 49. By pulling part of the cover 40 outwards, the user can manually open the cover 40 to the second opened position (e.g., shown in FIG. 4). In the second opened position, the first surface 42 faces away from the space 28, and the second surface 44 faces the space 28. Regular manual pulling force exerted on part of cover 40 makes the cover 40 lift and does not make the cover 40 revolve around the axis of the third pivot component 70. On the other hand, when the cover 40 is opened to the second opened position (shown in FIG. 4), the first cover part 88's pivot component 66 slides in the pathway 46 towards the second stop component 49 located at the second position 53. When the first cover part 88's pivot component 66 is constrained by the second stop component 49 from sliding farther away from the first position 51, the cover 40 will be prevented from further opening or moving.

Optionally, the operation of the cover 40 can be automated through the cover installation 120 (e.g., see FIG. 6) which includes the driving device 30. During the process of automatic operation of the cover installation 120, after receiving the first signal from starting device such as a button, a switch, a control lever or a sensor (not displayed), the driving device 30 is activated. The driving device 30 drives the connecting module 80, so as to make the first connecting component 82 revolve around the axis of the first pivot component 64 and the second connecting component 84 revolve around the axis of the second pivot component 68. The first cover part 88's pivot component 66 is restricted by the first stop component 47 from sliding in the pathway 46 toward the direction farther away from the second stop component 49. The cover 40, however, revolves around the axis of the third pivot component 70, opposite to the direction in which the first connecting component 82 and the second connecting component 84 revolve. In the first opened position, the first surface 42 of the cover 40 faces the space 28 which is outside of the opening of the cover installation; for example, it faces the user of the toilet bowl 25. In the first opened position, for example, when the cover 40 automatically opens, the user can sit on the toilet bowl 25 and lean backwards onto the first surface 42 (which is relatively cleaner).

In order to automatically close the cover 40, the driving device 30 is activated after receiving a second signal, so as to make the first connecting component 82 and the second connecting component 84 revolve opposite to the direction in which they were opened. The cover 40 revolves opposite to the direction in which it was opened. The cover 40 returns to its original closed position, and at such position, the first surface 42 faces the space 28 which is located at the outside of the covered equipment, such as the space 28 located above the toilet bowl 25.

The cover 40 can also be manually lifted and lowered. In order to manually open the cover 40, the user touches part of the cover 40 and exerts force on the cover 40. Such force extends outward along the equipment. For example, the user grips the forepart of the cover 40 and lifts the cover 40 upward along the direction deviating away from the toilet bowl 25. The first connecting component 82 revolves around the axis of the first pivot component 64 and the second connecting component 84 revolves around the axis of the second pivot component 68. The first cover part 88's pivot component 66 slides towards the second position 53 until the first cover part 88's pivot component 66 is stopped by the second stop component 49. The cover 40 stops at a position basically fixed relative to the axis of the third pivot component 70. In the fully opened position, the second surface 44 of the cover 40 faces the space 28 outside of the opening of said equipment; for example, it faces the user of the toilet bowl 25. For example, during the service process of the toilet bowl 25, any splashes or directionless objects caused by the user will all fall on the second surface 44 so that the first surface 42 will be kept relatively clean. The user can also grasp the grip component 52 located at the rear part of the cover 40, and lift it upwards along the direction away from the toilet bowl 25 so as to make the cover 40 revolve around the connecting module 80, so that the cover 40 and its first surface 42 faces the user of the toilet bowl 25, the same as what was described previously about how the cover 40 automatically opens.

In order to manually close the cover 40, the user can manipulate part of the cover 40. For example, the user can hold the part considered as the front part of the cover 40, and pull it downwards toward the toilet bowl 25. The first cover part 88's pivot component 66 slides towards the first position 51 within the pathway 46 until the first cover part 88's pivot component 66 is stopped by the first stop component 47. The user can either lead the cover 40 back to the closed position, or release the cover 40 after the cover part 40 is partially closed so as to make the cover fall back to the closed position by gravity. The user can also hold the part considered as the rear part of the cover 40 and then push or pull it downwards toward the toilet bowl 25, so as to make the cover 40 revolve around the connecting module 80 (e.g., in the same fashion as that described previously regarding how the cover 40 can automatically close).

The cover installations 20 and 120 can optionally include the locking component 50. When the cover 40 is opened to the first opened position, the coupling component 55 can resiliently constrain the first cover part 88's pivot component 66, so as to prevent it sliding toward the second position 53. The cover 40 revolves around the axis of the third pivot component 70 so as to make the first surface 42 face to the space 28 when the cover 40 is in the first opened position. In order to open the cover 40 to the second opened position, the coupling component 55 stops at a certain position so that the first cover part 88 is constrained from sliding toward the second position 53. With force, the coupling component 55 can break away from the pathway 46 so as to allow the first cover part 88's pivot component 66 to slide. The coupling component 55 can be somewhat flexible, so that the force from the first cover part 88 can lead to deformation of the coupling component 55. With sufficient deformation, the first cover part 88's pivot component 66 can slide through the coupling component and towards the second position 53. In alternative embodiments, the coupling component 55 can be magnetic. In the process of manual operation, the force originally exerted on the cover 40 by the user can overcomes the resilient constraint force which is exerted on the first cover part 88 by the connecting component 55, so as to force the first cover part 88's pivot component 66 to break away from the connecting component 55 and to slide in the pathway 46. In the process of automatic operation, the force that is exerted by the driving device 30 and transferred to the first cover part 88 is not exerted in the direction in which the first cover part 88 is made to break away from the coupling component 55, and the strength of said force is not enough to cause the first cover part 88 or the first cover part 88's pivot component 66 to break away from the coupling component 55.

In the embodiment, wherein the pathway 46 is an integral part of the cover 40, the pathway 46 is set to be on the surface of or within the cover 40. The size of the locking component 50 may be restricted in such an embodiment. Locking component 50 may be configured to provide enough constraint force so as to prevent the sliding movement of the first cover 88 in the pathway 46 in the process of automatic operation. However, if the cover 40 and the pathway 46 are structured in such a way that the center of gravity of the cover 40 lies at the front of the pathway 46 when the cover 40 is in the closed position, then the use of the locking component 50 may not be necessary.

After the cover 40 is manually opened, the cover 40 can also be automatically closed as previously described. Or, after the cover 40 is automatically opened, the cover 40 can also be manually closed as previously described.

In an exemplary embodiment, the cover installation 20 includes a base 60, a first surface 42, a second surface 44, a pathway 46, a third pivot component 70, a cover 40 of the locking component 50, a first connecting component 82 and a second connecting component 84. A first base 86 of the first connecting component 82 is connected to the base 60 by the first pivot component 64. A first cover part 88 (or the first cover's pivot component 66) of the first connecting component 82 is slidably coupled with the pathway 46. The first cover part 88 (or the first cover's pivot component 66) of the first connecting component 82 is restricted by the locking component 50 in releasable manner. A second connecting component 84 has a second base 90 and is connected to the base 60 by the second pivot component 68, and the second cover part 92 of the second connecting component 84 is pivotally connected to the third pivot component 70. A driving device 30 is optionally connected to at least one of the first connecting component 82 and the second connecting component 84.

In some embodiments, the first connecting component 82 is restricted by a locking component 50 in releasable manner. The driving device 30 is connected to the first connecting component 82. The first connecting component 82 can transmit the force from the driving device 30 so as to open and close the cover 40. When cover 40 is in the opened position the first surface 42 of the cover 40 faces the space 28. Such space 28 is above the area of the cover 40 when the cover 40 is in the closed position.

In another alternative embodiment of the present invention, the first connecting component 82 is restricted by the locking component 50 in releasable manner and the driving device 30 is connected to the second connecting component 84. The second connecting component 84 can transmit the force from the driving device 30 so as to open and close the cover 40. When the cover 40 is in the opened position, the first surface 42 of the cover 40 faces the space 28, which is above the area of the cover 40 when the cover 40 is in the closed position.

In one alternative embodiment of the present invention, the first connecting component 82 is restricted by the locking component 50 in releasable manner and the driving device 30 is connected to the first connecting component 82 and the second connecting component 84. The first connecting component 82 and the second connecting component 84 can transmit the force from the driving device 30 so as to open and close the cover 40. When the cover 40 is in the opened position, the first surface 42 of the cover 40 faces the space 28, which is above the area of the cover 40 when the cover 40 is in the closed position.

In an exemplary embodiment, the first connecting component 82 is a bar.

In an exemplary embodiment, the second connecting component 84 is a bar.

In an exemplary embodiment of the present invention, the pathway 46 is a groove.

What is claimed is:

1. A cover installation for a toilet or bidet, comprising:

a base configured to attach to the toilet or bidet;

a moveable cover including a first surface and a second opposite surface; and a connecting module configured to movably connect the cover to the base, the connecting module including a first connecting component, a second connecting component, a first pivot component, a second pivot component, a third pivot component, a fourth pivot component, and a pathway;

wherein the first connecting component is connected to the base by the first pivot component, and the first connecting component is connected to the cover by the third pivot component;

wherein the second connecting component is connected to the base by the fourth pivot component, and the second connecting component is connected to the cover by the second pivot component;

wherein the pathway is a sliding pathway and is a part of the cover; and wherein one of the second pivot component and the third pivot component is slidably set within the sliding pathway.

2. The cover installation of claim 1, wherein the pivot component is a hinge.

3. The cover installation of claim 1, further comprising at least one grip component coupled with the cover.

4. A cover installation for a toilet or bidet, comprising:

a base configured to attach to the toilet or bidet;

a moveable cover including a first surface and a second opposite surface; and a connecting module configured to movably connect the cover to the base, the connecting module including a first connecting component, a second connecting component, a first pivot component, a second pivot component, a third pivot component, a fourth pivot component, and a pathway;

wherein the first connecting component is connected to the base by the first pivot component, and the first connecting component is connected to the cover by the third pivot component;

wherein the second connecting component is connected to the base by the fourth pivot component, and the second connecting component is connected to the cover by the second pivot component; and wherein the pathway is a part of the base, and one of the first pivot component and the third pivot component is slidably set within the pathway.

5. The cover installation of claim 4, further comprising a locking module, and wherein a part of the first connecting component is located in the pathway and is releasably constrained by the locking component module from sliding in the pathway.

6. The cover installation of claim 5, wherein the locking module is coupled to the cover through a coupling component, and wherein the locking module releasably constrains the first connecting component against a first stop of the pathway.

7. The cover installation of claim 4, wherein the first connecting component is a bar.

8. A cover installation for a toilet or bidet, comprising:

a base configured to attach to the toilet or bidet;

a moveable cover including a first surface and a second opposite surface; and a connecting module configured to movably connect the cover to the base, the connecting module including a first connecting component, a second connecting component, a first pivot component, a second pivot component, a third pivot component, a fourth pivot component, and a pathway;

wherein the first connecting component is connected to the base by the first pivot component, and the first connecting component is connected to the cover by the third pivot component;

wherein the second connecting component is connected to the base by the fourth pivot component, and the second connecting component is connected to the cover by the second pivot component; and wherein the pathway is a part of at least one of the first connecting component and the second connecting component, and at least one of the first connecting component and the second connecting component includes at least two slidably coupling parts.

9. The cover installation of claim 8, further comprising a driving device connected to at least one of the first connecting component and the second connecting component.

10. The cover installation of claim 9, wherein the driving device is attached to the base and configured to exert a rotary force on the at least one of the first and second connecting components to move the cover to the opened position.

11. The cover installation of claim 8, wherein the second connecting component is a bar.

12. A cover installation for a toilet or bidet, comprising:

a base configured to attach to the toilet or bidet;

a moveable cover including a first surface and a second opposite surface; and a connecting module configured to movably connect the cover to the base, the connecting module including a first connecting component, a second connecting component, a first pivot component, a second pivot component, a third pivot component, a fourth pivot component, and a pathway;

wherein the first connecting component is connected to the base by the first pivot component, and the first connecting component is connected to the cover by the third pivot component;

wherein the second connecting component is connected to the base by the fourth pivot component, and the second connecting component is connected to the cover by the second pivot component; and wherein the pathway is a groove.

13. The cover installation of claim 12, wherein the pathway is a sliding pathway and is a part of the cover, and one of the second pivot component and the fourth pivot component is slidably set within the sliding pathway.

14. A cover installation for a toilet or bidet, comprising:

a base configured to attach to the toilet or bidet;

a moveable cover including a first surface and a second opposite surface; and a connecting module configured to movably connect the cover to the base, the connecting module including a first connecting component, a second connecting component, a first pivot component, a second pivot component, a third pivot component, a fourth pivot component, and a pathway;

wherein the first connecting component is connected to the base by the first pivot component, and the first connecting component is connected to the cover by the third pivot component;

wherein the second connecting component is connected to the base by the fourth pivot component, and the second connecting component is connected to the cover by the second pivot component;

wherein the pathway comprises a first end and a second end;

wherein when the cover is in the closed position, the cover is configured to extend forward from a mounting surface of the base and generally parallel with the mounting surface, and a part of the first connecting component is located in the pathway and is configured to be close to the first end of the pathway;

wherein the cover is movable to first and second open positions;

wherein when the cover is in the first open position, the part of the first connecting component located in the pathway is configured to be close to the first end of the pathway, and the first surface of the cover faces toward the toilet or bidet bowl; and wherein when the cover is in the second open position, the part of the first connecting component located in the pathway is configured to be close to the second end of the pathway, and the second surface of the cover faces toward the toilet or bidet bowl.

15. A cover installation for a toilet or bidet, comprising:

a base configured to attach to the toilet or bidet;

a cover configured to move relative to the base, the cover including a pathway therein; and a connecting module movably connecting the cover to the base, the connecting module comprising:

a first connecting component having a first end pivotally connected to the base at a first pivot and a second end slideably disposed in the pathway; and a second connecting component having a first end pivotally connected to the base at a second pivot and a second end pivotally coupled to the cover at a third pivot;

wherein the cover can be manually moved.

16. The cover installation of claim 15, wherein the pathway includes first and second stops configured to restrict the movement of the second end of the first connecting component.

17. The cover installation of claim 16, further comprising a driving device attached to the base and configured to exert a rotary force on one of the first and second connecting components to automatically move the cover.

18. The cover installation of claim 17, further comprising a second driving device attached to the base and configured to exert a rotary force on the other of the at least one of the first and second connecting components to automatically move the cover.

19. The cover installation of claim 18, wherein the first driving device rotates the first end of the first connecting component and the second driving device rotates the first end of the second connecting component.

20. The cover installation of claim 19, wherein the cover is configured to move between an opened position and a closed position, wherein when the cover is in the closed position, the first connecting component is generally parallel to the second connecting component, and wherein when the cover is in the opened position, the first connecting component is at an angle relative to the second connecting component.

* * * * *